US011762315B2

(12) United States Patent
Yokoyama et al.

(10) Patent No.: US 11,762,315 B2
(45) Date of Patent: Sep. 19, 2023

(54) IMAGE FORMING APPARATUS THAT IMPROVES CONTACT MEMBER DURABILITY AND SUPPRESSES OCCURRENCE OF CLEANING FAILURE

(71) Applicant: CANON KABUSHIKI KAISHA, Tokyo (JP)

(72) Inventors: Ken Yokoyama, Mishima (JP); Shuji Saito, Suntou-gun (JP); Koujirou Izumidate, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/497,465

(22) Filed: Oct. 8, 2021

(65) Prior Publication Data

US 2022/0026832 A1 Jan. 27, 2022

Related U.S. Application Data

(63) Continuation of application No. 16/383,304, filed on Apr. 12, 2019, now Pat. No. 11,169,472.

(30) Foreign Application Priority Data

Apr. 27, 2018 (JP) ..... 2018-087522

(51) Int. Cl.
*G03G 15/16* (2006.01)
*G03G 21/12* (2006.01)

(52) U.S. Cl.
CPC ..... *G03G 15/162* (2013.01); *G03G 15/161* (2013.01); *G03G 21/12* (2013.01); *G03G 2221/0005* (2013.01)

(58) Field of Classification Search
CPC ..... G03G 15/161; G03G 15/162; G03G 2215/1623; G03G 2215/1661
See application file for complete search history.

(56) References Cited

U.S. PATENT DOCUMENTS

2012/0034479 A1* 2/2012 Kimpara ..... G03G 15/162 428/473.5

FOREIGN PATENT DOCUMENTS

| | | | |
|---|---|---|---|
| CN | 101055456 | A | 10/2007 |
| CN | 101513772 | A | 8/2009 |
| JP | 2003-29538 | A | 1/2003 |

* cited by examiner

*Primary Examiner* — Thomas S Giampaolo, II
(74) *Attorney, Agent, or Firm* — Canon U.S.A., Inc., IP Division

(57) ABSTRACT

An image forming apparatus includes an intermediate transfer member. The intermediate transfer member includes a layer made of an acrylic copolymer. A plurality of grooves is formed in the layer along a moving direction of the intermediate transfer member across a width direction of the intermediate transfer member. A groove distance that is an average distance between adjoining grooves of the plurality of grooves in the width direction of the intermediate transfer member is 2 μm or more and 10 μm or less.

29 Claims, 7 Drawing Sheets

FIG.5

| | GROOVE DISTANCE l [μm] | NUMBER OF SHEETS AT WHICH CLEANING FAILURE IMAGE OCCURS | | | | |
|---|---|---|---|---|---|---|
| | | 100000 SHEETS | 175000 SHEETS | 250000 SHEETS | 255000 SHEETS | 320000 SHEETS |
| FIRST EXEMPLARY EMBODIMENT | 3.5 | OK | OK | OK | OK | OK |
| FIRST MODIFICATION | 2.0 | OK | OK | OK | OK | NG |
| SECOND MODIFICATION | 2.3 | OK | OK | OK | OK | OK |
| THIRD MODIFICATION | 6.8 | OK | OK | OK | NG | NG |
| FOURTH MODIFICATION | 10 | OK | OK | NG | NG | NG |
| FIRST COMPARATIVE EXAMPLE | 19 | OK | NG | NG | NG | NG |

FIG.7

| GROOVE DISTANCE l (μm) | 19.0 | | | | 10.0 | | | | 6.8 | | | | 3.5 | | | | 2.3 | | | | 2.0 | | | |
|---|---|---|---|---|---|---|---|---|---|---|---|---|---|---|---|---|---|---|---|---|---|---|---|---|
| AMOUNT OF INTRUSION δ / SET ANGLE θ | 0.6 | 1 | 1.4 | 1.8 | 0.6 | 1 | 1.4 | 1.8 | 0.6 | 1 | 1.4 | 1.8 | 0.6 | 1 | 1.4 | 1.8 | 0.6 | 1 | 1.4 | 1.8 | 0.6 | 1 | 1.4 | 1.8 |
| 20 | NG | NG | NG | NG | NG | OK | NG | NG | OK | NG | NG | NG | OK | OK | NG | NG | NG | NG | NG | NG | NG | NG | NG | NG |
| 24 | NG | OK | NG | NG | OK | OK | NG | NG | OK | OK | NG | NG | OK | OK | OK | NG | NG | OK | NG | NG | NG | NG | NG | NG |
| 28 | NG | OK | OK | NG | NG | OK | OK | NG | OK | OK | OK | NG | OK | OK | OK | OK | OK | OK | OK | NG | NG | OK | OK | NG |
| 32 | NG | NG | NG | NG | NG | NG | NG | NG | OK | OK | OK | OK | OK | OK | OK | OK | OK | OK | OK | OK | NG | OK | OK | OK |

IMAGE FORMING APPARATUS THAT IMPROVES CONTACT MEMBER DURABILITY AND SUPPRESSES OCCURRENCE OF CLEANING FAILURE

CROSS-REFERENCE TO RELATED APPLICATIONS

This application is a continuation of U.S. application Ser. No. 16/383,304, filed Apr. 12, 2019, which claims the benefit of Japanese Patent Application No. 2018-087522, filed Apr. 27, 2018, each of which is hereby incorporated by reference herein in their entirety.

BACKGROUND OF THE DISCLOSURE

Field of the Disclosure

The present disclosure relates to an electrophotographic image forming apparatus such as a copying machine and a printer.

Description of the Related Art

Electrophotographic color image forming apparatuses configured to use an intermediate transfer method have been known heretofore. According to the intermediate transfer method, toner images are successively transferred from image forming units of respective colors to an intermediate transfer member, and then the toner images are simultaneously transferred from the intermediate transfer member to a transfer material.

In such an image forming apparatus, the image forming units of respective colors each include a drum-shaped photosensitive member (hereinafter, referred to as a photosensitive drum) serving as an image bearing member. An intermediate transfer belt made of an endless belt is widely used as the intermediate transfer member. Toner images formed on the photosensitive drums of the image forming units are primarily transferred to the intermediate transfer belt by the application of a voltage from a primary transfer power supply to primary transfer members opposed to the photosensitive drums with the intermediate transfer belt therebetween. The toner images of respective colors primarily transferred from the image forming units of respective colors to the intermediate transfer belt are simultaneously secondarily transferred from the intermediate transfer belt to a transfer material, such as a sheet of paper and an overhead projector (OHP) sheet, by the application of a voltage from a secondary transfer power supply to a secondary transfer member in a secondary transfer portion. The toner images of respective colors transferred to the transfer material are then fixed to the transfer material by a fixing unit.

In the intermediate transfer image forming apparatus, toner (transfer residual toner) remains on the intermediate transfer belt after the secondary transfer of the toner images from the intermediate transfer belt to the transfer material. The transfer residual toner remaining on the intermediate transfer belt therefore needs to be removed before toner images corresponding to the next image are primarily transferred to the intermediate transfer belt.

A blade cleaning method is widely used as a cleaning method for removing the transfer residual toner. In the blade cleaning method, the transfer residual toner is scraped off and collected into a cleaning container by a cleaning blade that is arranged downstream of the secondary transfer portion in the moving direction of the intermediate transfer belt and serves as a contact member making contact with the intermediate transfer belt. An elastic body such as urethane rubber is typically used as the cleaning blade. The cleaning blade is often arranged so that the edge portion of the cleaning blade is pressed against the intermediate transfer belt in a direction (counter direction) opposite to the moving direction of the intermediate transfer belt. Here, a collection nip portion for collecting the transfer residual toner is formed at a position where the cleaning blade and the intermedia transfer belt are pressed against each other.

Japanese Patent Application Laid-Open No. 2015-125187 discusses a configuration for suppressing abrasion of the cleaning blade. In the configuration, grooves along the moving direction of the intermediate transfer belt are formed in the surface of the intermediate transfer belt to reduce the coefficient of friction between the cleaning blade and the intermediate transfer belt. Specifically, Japanese Patent Application Laid-Open No. 2015-125187 discusses grooves having a groove pitch (distance in a direction substantially orthogonal to a belt conveyance direction) of 10 μm to 100 μm, typically 10 μm to 20 μm.

According to the groove configuration discussed in Japanese Patent Application Laid-Open No. 2015-125187, a certain level of cleaning performance is ensured. However, it can be difficult to suppress the abrasion of the cleaning blade throughout the product life if an extended period of use is intended. To suppress the abrasion of the cleaning blade for improved durability, the coefficient of friction between the cleaning blade and the intermediate transfer belt can be reduced further. On the other hand, if the coefficient of friction between the cleaning blade and the intermediate transfer belt is set too low, the transfer residual toner can pass through the collection nip portion to cause a cleaning failure. In other words, to improve the durability of the cleaning blade and suppress the occurrence of a cleaning failure as well, the coefficient of friction between the cleaning blade and the intermediate transfer belt needs to be set appropriately.

SUMMARY OF THE DISCLOSURE

The present disclosure is directed to improving the durability of a contact member and suppress the occurrence of a cleaning failure in a configuration that collects toner remaining on an intermediate transfer member by using the contact member making contact with the intermediate transfer member.

According to an aspect of the present disclosure, an image forming apparatus includes an image bearing member configured to bear a toner image, a movable intermediate transfer member configured to contact with the image bearing member, the toner image borne on the image bearing member being primarily transferred to the intermediate transfer member, and a collection unit arranged downstream of a secondary transfer portion with respect to a moving direction of the intermediate transfer member, the secondary transfer portion being configured to secondarily transfer the toner image primarily transferred to the intermediate transfer member from the intermediate transfer member to a transfer material, the collection unit including a contact member configured to contact with the intermediate transfer member, the collection unit being configured to collect toner remaining on the intermediate transfer member having passed through the secondary transfer portion by using the contact member, wherein the intermediate transfer member includes a layer made of an acrylic copolymer on an outer peripheral surface that makes contact with the image bearing member and the contact member, a plurality of grooves being formed in the layer along the moving direction across a width direction of the intermediate transfer member, the width direction intersecting the moving direction, and wherein an average distance between adjoining grooves of the plurality of grooves in the width direction is 2 μm or more and 10 μm or less.

Further features and aspects of the present disclosure will become apparent from the following description of example embodiments with reference to the attached drawings.

BRIEF DESCRIPTION OF THE DRAWINGS

FIG. 5 is a table illustrating evaluation results of cleaning performance according to the first example embodiment.

FIG. 7 is a table illustrating evaluation results of cleaning performance according to a second example embodiment.

DESCRIPTION OF THE EMBODIMENTS

Example embodiments, various aspects and features of the present disclosure will be described in detail below with reference to the drawings. Dimensions, materials, shapes, and relative arrangement of components described in the following example embodiments should be appropriately changed depending on configuration and various conditions of an apparatus to which the present disclosure is applied. The scope of the present disclosure is therefore not limited thereto unless otherwise specified.

Figure 1:
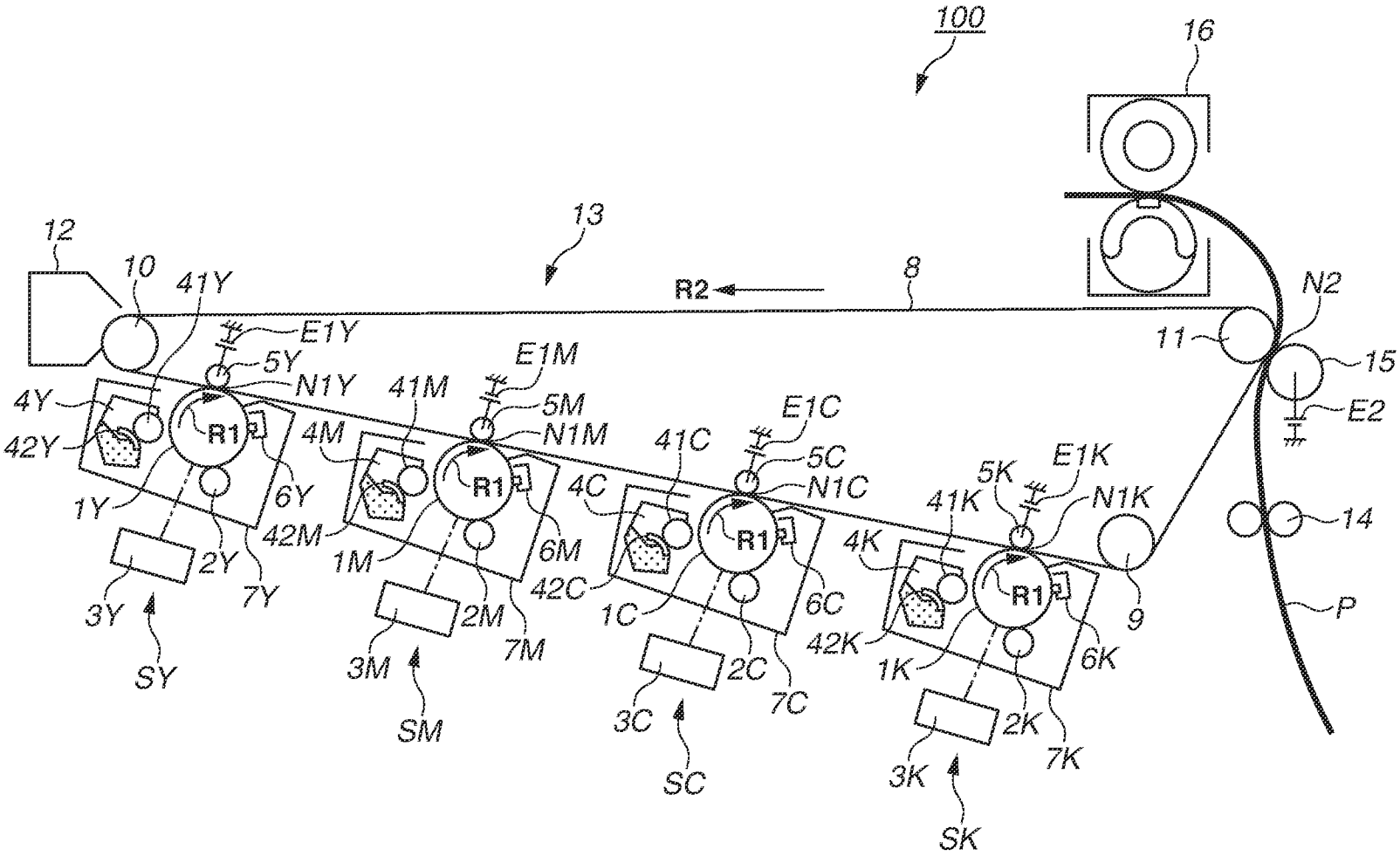
FIG. 1 is a schematic sectional view illustrating an example general configuration of an image forming apparatus according to a first example embodiment.

A first example embodiment will be described below. FIG. 1 is a schematic sectional view illustrating a general configuration of an image forming apparatus 100 according to the present example embodiment. The image forming apparatus 100 according to the present example embodiment is a tandem laser beam printer using an intermediate transfer system capable of forming a full color image by using an electrophotographic method.

The image forming apparatus 100 includes four image forming units SY, SM, SC, and SK arranged in a row. The image forming units SY, SM, SC, and SK form images in yellow (Y), magenta (M), cyan (C), and black (K), respectively. In the present example embodiment, the configurations and operations of the image forming units SY, SM, SC, and SK are substantially the same except that toners of different colors are used. Components will therefore be described in a comprehensive manner by omitting Y, M, C, and K indicating colors that the components are intended for at the ends of the reference numerals unless distinction is particularly needed.

The image forming units S each include a drum-shaped (cylindrical) photosensitive drum 1 serving as an image bearing member. The photosensitive drum 1 is driven to rotate in the direction of the arrow R1 in FIG. 1. A charging roller 2, an exposure unit 3, a developing unit 4, and a drum cleaning unit 6 are arranged around the photosensitive drum 1 in order along the direction of rotation of the photosensitive drum 1. The charging roller 2 is a roller-shaped charging member serving as a charging unit. The drum cleaning unit 6 collects toner remaining on the photosensitive drum 1.

The developing unit 4 contains a nonmagnetic one-component developing agent as its developer. The developing unit 4 includes a developing sleeve 41 serving as a developer bearing member and a developer application blade 42 serving as a developer regulation unit. In each image forming unit S, the photosensitive drum 1 and the charging roller 2, developing unit 4, and drum cleaning unit 6 serving as process units acting on the photosensitive drum 1 are configured as a process cartridge 7 that is integrally detachably attachable to an apparatus main body of the image forming apparatus 100. The exposure unit 3 includes a scanner unit that performs scanning with laser light by using a polygonal mirror. The exposure unit 3 irradiates the photosensitive drum 1 with a scanning beam modulated based on an image signal.

An intermediate transfer belt 8 made of an endless belt serving as a movable intermediate transfer member is arranged to make contact with all the photosensitive drums 1Y, 1M, 1C, and 1K of the respective image forming units SY, SM, SC, and SK. The intermediate transfer belt 8 is stretched across three rollers including a driving roller 9, a tension roller 10, and a secondary transfer counter roller 11 (hereinafter, referred to simply as a counter roller 11). As the driving roller 9 is driven to rotate, the intermediate transfer belt 8 moves (rotates) in a belt conveyance direction indicated by the direction of the arrow R2 in the diagram.

A primary transfer roller 5 serving as a primary transfer member is arranged at a position opposed to each photosensitive drum 1 with the intermediate transfer belt 8 therebetween. The primary transfer roller 5 is biased toward the photosensitive drum 1 at a predetermined pressure with the intermediate transfer belt 8 therebetween. This forms a primary transfer portion (primary transfer nip) N1 in which the intermediate transfer belt 8 and the photosensitive drum 1 contact each other. A secondary transfer roller 15 serving as a secondary transfer member is arranged on the outer peripheral surface side of the intermediate transfer belt 8 at a position opposed to the counter roller 11. The secondary transfer roller 15 is biased toward the counter roller 11 at a predetermined pressure with the intermediate transfer belt 8 therebetween. This forms a secondary transfer portion (secondary transfer nip) N2 in which the intermediate transfer belt 8 and the secondary transfer roller 15 contact each other.

A belt cleaning unit 12 serving as a collection unit is arranged on the outer peripheral surface side of the intermediate transfer belt 8 at a position opposed to the tension roller 10. The intermediate transfer belt 8 supported by the foregoing three rollers 9, 10, and 11 and the belt cleaning unit 12 are unitized into an intermediate transfer belt unit 13 detachably attachable to the apparatus main body of the image forming apparatus 100.

When an image forming operation is started, the photosensitive drums 1 and the intermediate transfer belt 8 start to rotate in the directions of the arrows R1 and R2, respectively, at a predetermined process speed. The surfaces of the rotating photosensitive drums 1 are substantially uniformly charged to a predetermined polarity (in the present example embodiment, negative polarity) by the charging rollers 2. Here, a predetermined charging voltage is applied from a not-illustrated charging power supply to the charging rollers 2. The photosensitive drums 1 are then exposed by the exposure units 3 based on image information corresponding to the respective image forming units S, whereby electrostatic latent images based on the image information are formed on the surfaces of the photosensitive drums 1.

The developing sleeves 41 bear toner charged to a normal charging polarity of toner (in the present example embodiment, negative polarity) by the developer application blades 42. A predetermined developing voltage is applied from a not-illustrated developing power supply to the developing sleeves 41. The latent images formed on the photosensitive drums 1 are visualized by the toner of negative polarity at portions (developing portions) where the photosensitive drums 1 and the developing sleeves 41 are opposed, whereby toner images are formed on the photosensitive drums 1.

The toner images formed on the photosensitive drums 1 are transferred (primarily transferred) to the intermediate transfer belt 8 being driven to rotate, at the primary transfer portions N1 by the action of the primary transfer rollers 5. Here, a primary transfer voltage having a polarity (in the present example embodiment, positive polarity) opposite to the normal charging polarity of toner is applied from primary transfer power supplies E1 to the primary transfer rollers 5. For example, during formation of a full color image, electrostatic latent images are formed on the photosensitive drums 1 in the respective image forming units S. The electrostatic latent images are developed into toner images of the respective colors. The toner images of the respective colors formed on the photosensitive drums 1 of the image forming units S are successively transferred to the intermediate transfer belt 8 at the respective primary transfer portions N1Y, N1M, N1C, and N1K in a superposed manner, whereby four color toner images are formed on the intermediate transfer belt 8.

A transfer material P such as recording sheets stacked in a not-illustrated transfer material storage cassette is conveyed to registration rollers 14 by a not-illustrated feed roller and not-illustrated conveyance rollers. The transfer material P is conveyed by the registration rollers 14 to the secondary transfer portion N2 formed between the intermediate transfer belt 8 and the secondary transfer roller 15 in synchronization with the toner images on the intermediate transfer belt 8. In the secondary transfer portion N2, the four-color multiple toner images borne on the intermediate transfer belt 8 are simultaneously transferred to the transfer material P by the action of the secondary transfer roller 15. Here, a secondary transfer voltage having a polarity (in the present example embodiment, positive polarity) opposite to the normal charging polarity of toner is applied from a secondary transfer power supply E2 to the secondary transfer roller 15.

The transfer material P to which the toner images are transferred is then conveyed to a fixing unit 16. The toner images secondarily transferred to the transfer material P are pressed and heated in the process of being nipped and conveyed by a fixing roller and a pressure roller of the fixing unit 16, whereby the toner images are fixed to the transfer material P. The transfer material P is then discharged out of the apparatus main body of the image forming apparatus 100.

Transfer residual toner remaining on the intermediate transfer belt 8 after the secondary transfer is removed from the surface of the intermediate transfer belt 8 by the belt cleaning unit 12 that is opposed to the tension roller 10 with the intermediate transfer belt 8 therebetween. As will be described in detail below, the belt cleaning unit 12 is arranged downstream of the secondary transfer portion N2 with respect to the moving direction of the intermediate transfer belt 8. The belt cleaning unit 12 includes a cleaning blade 21 (contact member) that makes contact with the outer peripheral surface of the intermediate transfer belt 8 at a position opposed to the tension roller 10.

The toners used in the present example embodiment contain toner particles having an average particle size of 6.4 μm, manufactured by emulsion polymerization aggregation, to which fine silica particles having an average particle size of 20 nm are externally added. An average particle size refers, for example, to a weight-average particle size, which can be measured by the Coulter method. An example of the measuring instrument is "Coulter Counter Multisizer 3" (manufactured by Beckman Coulter, Inc.), which is accompanied by dedicated software "Beckman Coulter Multisizer 3 Version 3.51" (manufactured by Beckman Coulter, Inc.) for setting measurement conditions and analyzing measurement data. The method for manufacturing toner particles is not limited to emulsion polymerization aggregation. Toner particles may be manufactured by other methods, including pulverization, suspension polymerization, and dissolution suspension.

[Belt Cleaning Unit]

Figure 2A:
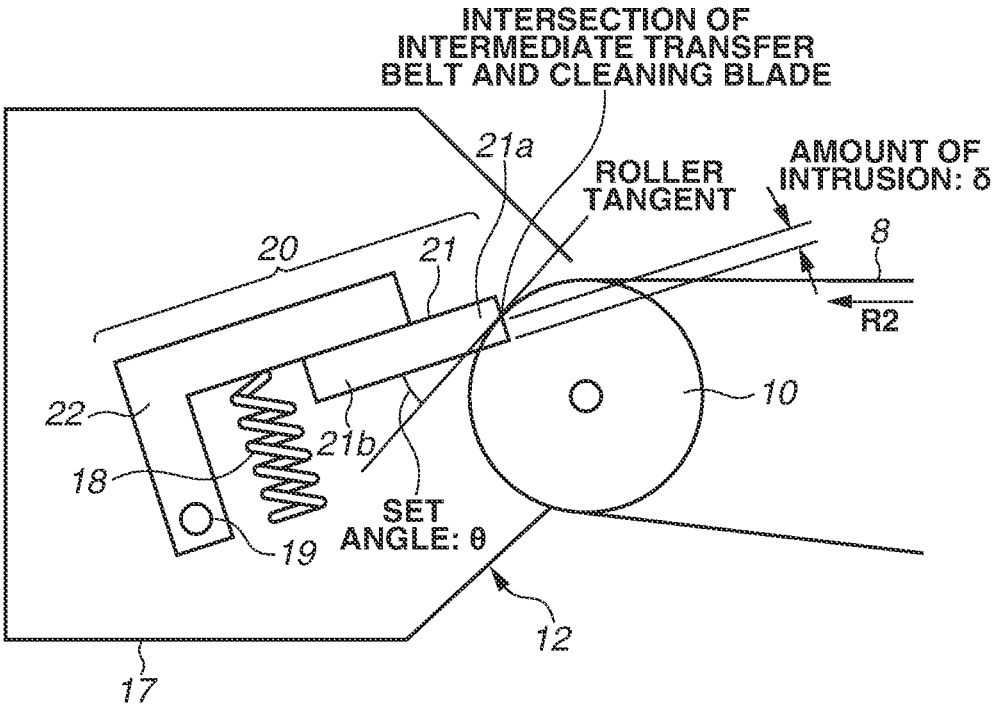
FIGS. 2A and 2B are main cross-sectional views near a belt cleaning unit according to the first example embodiment.
Figure 2B:
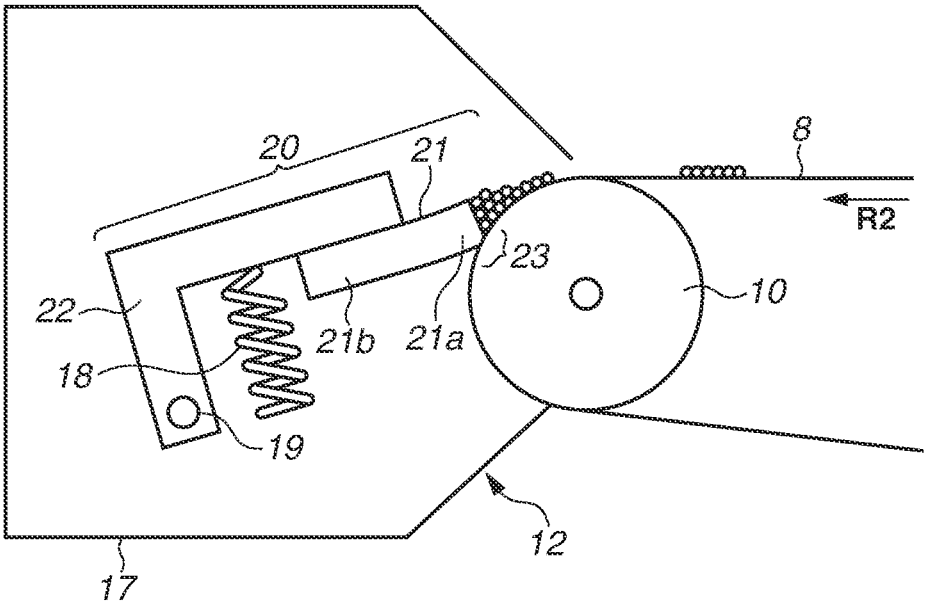

FIG. 2A is a virtual sectional view illustrating an attachment position of the cleaning blade 21 to be described below when the cleaning blade 21 is not elastically deformed. FIG. 2B is a schematic sectional view illustrating a configuration of the belt cleaning unit 12.

The belt cleaning unit 12 includes a cleaning container 17 and a cleaning operation unit 20 arranged in the cleaning container 17. The cleaning container 17 is configured as part of a frame of an intermediate transfer unit (not illustrated) including the intermediate transfer belt 8. The cleaning operation unit 20 includes the cleaning blade 21 serving as a cleaning member (contact member) and a support member 22 supporting the cleaning blade 21. The cleaning blade 21 is an elastic blade made of urethane rubber (polyurethane) that is an elastic material. The cleaning blade 21 is supported by the support member 22 formed of a metal plate made of a plated steel sheet as bonded to the support member 22.

The cleaning blade 21 is a plate-like member elongated in the width direction of the intermediate transfer belt 8. The width direction (longitudinal direction of the cleaning blade 21) intersects the moving direction of the intermediate transfer belt 8 (hereinafter, referred to as a belt conveyance direction). The cleaning blade 21 is fixed in a state where a lateral end portion 21*a* on the free end side is in contact with the intermediate transfer belt 8 and a lateral end portion 21*b* on the fixed end side is bonded to the support member 22. The cleaning blade 21 has a longitudinal length of 230 mm and a thickness of 2 mm. The hardness of the cleaning blade 21 according to Japanese Industrial Standard (JIS) K 6253 is 77°.

The cleaning operation unit 20 is configured to be swingable with respect to the surface of the intermediate transfer belt 8. More specifically, the support member 22 is supported to be swingable with respect to the surface of the intermediate transfer belt 8 via a swing shaft 19 fixed to the cleaning container 17. The support member 22 is pressed by a pressure spring 18 serving as a biasing unit arranged in the cleaning container 17. This makes the cleaning operation unit 20 movable about the swing shaft 19, and the cleaning blade 21 is biased toward (pressed against) the intermediate transfer belt 8.

The tension roller 10 is arranged on the inner periphery side of the intermediate transfer belt 8, opposite to the cleaning blade 21. The cleaning blade 21 is put in contact with the surface of the intermediate transfer belt 8 in a counter direction to the belt conveyance direction at the position opposed to the tension roller 10. In other words, the cleaning blade 21 makes contact with the surface of the intermediate transfer belt 8 so that the lateral end portion 21*a* on the free end side is directed upstream with respect to the belt conveyance direction. As illustrated in FIG. 2B, a blade nip portion 23 is thereby formed between the cleaning blade 21 and the intermediate transfer belt 8. In the blade nip portion 23, the cleaning blade 21 scrapes transfer residual toner off the surface of the moving intermediate transfer belt 8 and collects the transfer residual toner into the cleaning container 17.

In the present example embodiment, the attachment position of the cleaning blade 21 is set as follows. As illustrated in FIG. 2A, a set angle θ is 24°, the amount of intrusion δ is 1.5 mm, and a contact pressure is 0.6 N/cm. As employed herein, the set angle θ refers to an angle formed between the tangent to the tension roller 10 at the intersection of the intermediate transfer belt 8 and the cleaning blade 21 (more specifically, the end face on the free end side) and the cleaning blade 21 (more specifically, one surface substantially orthogonal to the thickness direction thereof). The amount of intrusion δ refers to a length for which the cleaning blade 21 overlaps the tension roller 10 in the thickness direction. The contact pressure is defined by a pressing force (linear pressure along the longitudinal direction) acting on the blade nip portion 23 from the cleaning blade 21. The contact pressure is measured by using a film-type pressure measurement system (product name: PINCH, manufactured by Nitta Corporation). Such settings can suppress curling and slip noise of the cleaning blade 21 under a high-temperature, high-humidity environment and provide good cleaning performance. Such settings can also suppress a cleaning failure under a low-temperature, low-humidity environment and provide good cleaning performance.

Urethane rubber and synthetic resin typically have high frictional resistance against sliding therebetween, and are likely to cause initial curling of the cleaning blade 21. An initial lubricant such as graphite fluoride can be applied to the end portion 21*a* of the cleaning blade 21 on the free end side in advance.

The rubber hardness of the cleaning blade 21 is selected as appropriate based on the material of the intermediate transfer belt 8, and can be in the range of 70° or more and 80° or less according to JIS K 6253. If the rubber hardness is lower than the foregoing range, the amount of abrasion during use can increase thereby lowering durability. If the rubber hardness is higher than the foregoing range, elastic force can decrease to cause chippings due to friction against the intermediate transfer belt 8. The contact pressure of the cleaning blade 21 is selected as appropriate based on the material of the intermediate transfer belt 8, and can be in the range of 0.4 N/cm or more and 0.8 N/cm or less. If the contact pressure is lower than the foregoing range, the cleaning blade 21 can fail to provide good cleaning performance. If the contact pressure is higher than the foregoing range, the load for driving the intermediate transfer belt 8 to rotate can be too high.

[Example Intermediate Transfer Belt]

Figure 3A:
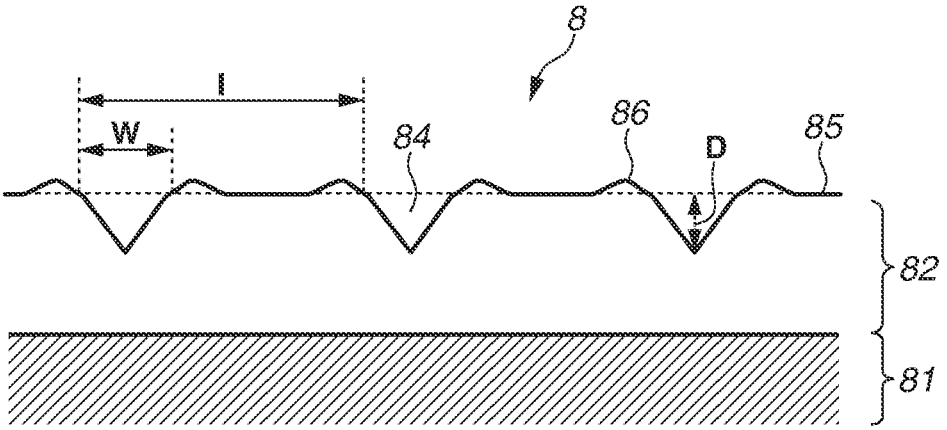
FIGS. 3A and 3B are schematic diagrams illustrating an example configuration of an intermediate transfer belt according to the first example embodiment.
Figure 3B:
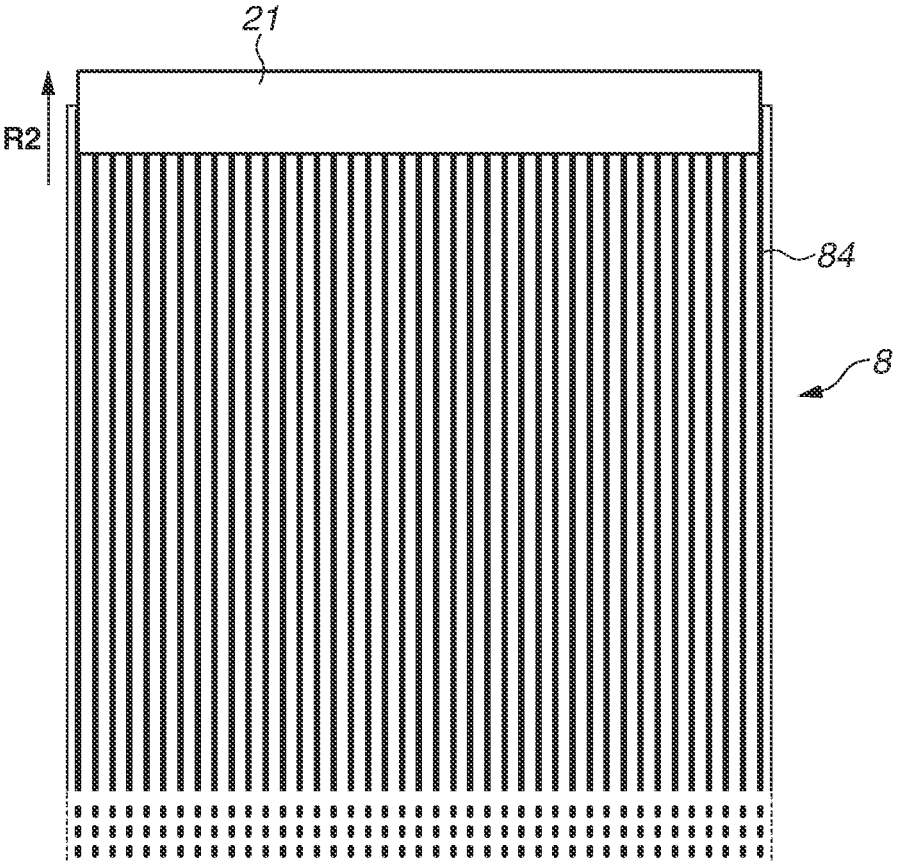

Next, a configuration of the intermediate transfer belt 8 unique to the present example embodiment will be described. FIG. 3A is a schematic enlarged partial sectional view of the intermediate transfer belt 8, taken along a direction substantially orthogonal to the belt conveyance direction (as seen in the belt conveyance direction). FIG. 3B is a schematic top view of the surface of the intermediate transfer belt 8 seen from above.

The intermediate transfer belt 8 is an endless belt member (or film member) including two layers: a base layer 81 and a surface layer 82. As employed herein, the base layer is defined as the thickest layer among layers constituting the intermediate transfer belt 8 with respect to the thickness direction of the intermediate transfer belt 8. The surface layer 82 bears the toner images primarily transferred from the photosensitive drums 1 to the intermediate transfer belt 8. In the present example embodiment, the base layer 81 is a 70-μm-thick layer of polyethylene naphthalate resin in which a quaternary ammonium salt that is an ion conductive agent serving as an electrical resistance adjustment agent is dispersed. The surface layer 82 is a layer of approximately 3 μm in thickness, formed by dispersing an electrical resistance adjustment agent, such as zinc oxide, in an acrylic resin base material.

Urethane rubber and synthetic resin typically have high frictional resistance against sliding therebetween, and are likely to cause curling and long-term abrasion of the cleaning blade 21. In the present example embodiment, surface finishing for suppressing the abrasion of the cleaning blade 21 is then applied to the surface layer 82, whereby grooves (groove shapes, groove portions) 84 are formed along the belt conveyance direction. More specifically, as illustrated in FIGS. 3A and 3B, a plurality of grooves 84 is formed along the moving direction of the intermediate transfer belt 8 (the direction of the arrow R2 in FIG. 3B) by fine pattern machining across the width direction of the intermediate transfer belt 8 orthogonal to the moving direction of the intermediate transfer belt 8.

Conventional polishing, cutting, and imprinting units are commonly known as units for forming a fine pattern. In the present example embodiment, the intermediate transfer belt 8 having the grooves 84 formed in the surface thereof can be obtained by using a suitable forming unit selected as appropriate from among such forming units. In view of machining cost and productivity, imprinting that utilizes the photosetting property of acrylic resin serving as a base material for the finely machined surface can be suitably performed. The grooves 84 may be formed by performing a lapping process after the acrylic resin is cured.

In the present example embodiment, the grooves 84 are formed in the surface of the intermediate transfer belt 8 by an imprinting process in which a die (not illustrated) having a fine pattern shape is pressed against the intermediate transfer belt 8 to transfer the fine pattern shape of the die to the surface layer 82 of the intermediate transfer belt 8. As illustrated in FIG. 3A, lands 86 (protrusions) can be formed on both sides of the grooves 84 formed by imprinting. The lands 86 are formed to rise and protrude from an outermost surface 85 of the surface layer 82 when the base material of the surface layer 82 is pushed by the fine protrusions of the die. Such a surface shape can be measured, for example, by a laser microscope VK-X250 manufactured by KEYENCE CORPORATION. The grooves 84 extend along the moving direction of the intermediate transfer belt 8 all around the intermediate transfer belt 8.

The width W illustrated in FIG. 3A is the opening width of a groove 84 in the width direction of the intermediate transfer belt 8. The width W is defined as the range where the surface layer 82 is formed in a smaller thickness as a groove with respect to the outermost surface 85 of the surface layer 82. For example, the grooves 84 have a width W of 1 μm. If the lands 86 mentioned above are relatively large, the gaps between the peaks of the lands 86 may be regarded as openings, and the distances between the peaks of the lands 86 may be defined as the width W. The depth D illustrated in FIG. 3A is defined as the depth from the surface (opening) where no groove is formed in the surface layer 82 to the bottom of a groove 84 in the thickness direction of the intermediate transfer belt 8. The depth D is 0.2 μm or more and less than the thickness of the surface layer 82. The grooves 84 are formed to not reach the base layer 81 but remain within the surface layer 82.

The width W of the grooves 84 can be less than half the average particle diameter of the toner. Configuring the grooves 84 to have a width W of less than half the average particle diameter of the toner can suppress entering of the toner into the grooves 84 and slipping of the toner through the cleaning blade 21 in the blade nip portion 23. If the width W of the grooves 84 is too small, the contact area between the cleaning blade 21 and the intermediate transfer belt 8 becomes too large. This can increase the friction in the blade nip portion 23 and promote the abrasion of the end of the cleaning blade 21. In the configuration of the present example embodiment, the width W of the grooves 84 can be set to 0.5 μm or more and 3 μm or less.

The distance I illustrated in FIG. 3A is defined as the distance between the left ends of the openings of adjoining grooves 84. An average distance of the grooves 84 defined in the present example embodiment is an average of the distances I between the plurality of grooves 84 in the width direction of the intermediate transfer belt 8, and will hereinafter be referred to simply as a groove distance I. In the present example embodiment, the grooves 84 are formed by setting the distances I at equal pitches of 3.5 μm. It will be understood that the distance I may be defined as the distance between the right ends of the openings of adjoining grooves 84. The distance I may be defined as the distance between the bottoms of the openings of adjoining grooves 84.

Examples of materials used for the base layer 81 include thermoplastic resins such as polycarbonate, polyvinylidene difluoride (PVDF), polyethylene, polypropylene, polystyrene, polyamide, polyarylate polyethylene naphthalate, polybutylene naphthalate, and thermoplastic polyimide. Two or more of the materials may be used in mixture.

For the surface layer 82 of the intermediate transfer belt 8, resin materials (curable resins) can be suitably used among curable materials in terms of strength such as abrasion resistance and cracking resistance. Of curable resins, acrylic resins obtained by curing unsaturated double bond-containing acrylic copolymers can be suitably used. Examples of unsaturated double bond-containing acrylic copolymers available include LUCIFRAL (product name, manufactured by Nippon Paint Co., Ltd.) which is an acrylic ultraviolet curing hardcoat material.

To adjust electrical resistance, a conductive agent (conductive fillers, electrical resistance adjustment agent) may be added to the surface layer 82. An electron conductive agent or ion conductive agent may be used as the conductive agent. Examples of the electron conductive agent include particulate, fibrous, and flaky carbon-based conductive fillers such as carbon black. Particulate, fibrous, and flaky metal-based conductive fillers of silver, nickel, copper, zinc, aluminum, stainless steel, and iron may be used. Other examples include particulate metal oxide conductive fillers such as zinc antimonate and tin oxide. Examples of the ion conductive agent include ionic liquids, conductive oligomers, and quaternary ammonium salts. One or more of the conductive agents may be selected as appropriate. An electron conductive agent and an ion conductive agent may be used in mixture.

In the present example embodiment, an ion conductive agent is used as a conductive agent added to the base layer 81. However, this is not restrictive. An electron conductive agent may be added to impart conductivity to the base layer 81. An electron conductive agent and an ion conductive agent may be added in mixture to impart conductivity to the base layer 81. The foregoing conductive agents available to be added to the surface layer 82 may be used as the ion conductive agent and the electron conductive agent.

The surface layer 82 needs to have a thickness such that the grooves 84 can be formed, i.e., a thickness greater than or equal to the depth D of the grooves 84. If the thickness of the surface layer 82 is smaller than the depth D of the grooves 84, the grooves 84 reach the base layer 81. Substances added to the base layer 81 can then deposit on the surface of the surface layer 82 to cause a cleaning failure. On the other hand, if the surface layer 82 is too thick, the surface layer 82 made of acrylic resin can crack to cause a cleaning failure. In the configuration of the present example embodiment, the thickness of the surface layer 82 can be set within the range of 1 μm or more and 5 μm or less. In consideration of cracking of the surface layer 82 for long-term use, the thickness can desirably be set within the range of 1 μm or more and 3 μm or less.

[Evaluation of Cleaning Performance]

Evaluation results of cleaning performance of intermediate transfer belts according to the present example embodiment, first to fourth modifications, and a first comparative example, in which the groove distance I was set to respectively different values, will be described below with reference to FIG. 4. The intermediate transfer belt 8 according to the present example embodiment had a groove distance I of 3.5 μm. In the first comparative example, an intermediate transfer belt having a groove distance I of 19 μm was used. The intermediate transfer belts according to the first, second, third, and fourth modifications were set to a groove distance I of 2.0 μm, 2.3 μm, 6.8 μm, and 10.0 μm, respectively. The configurations according to the present example embodiment, the first to fourth modifications, and the first comparative example were substantially the same except that the groove distances I were different. Common portions will hereinafter be designated by the same reference numerals, and a description thereof will be omitted.

Figure 4:
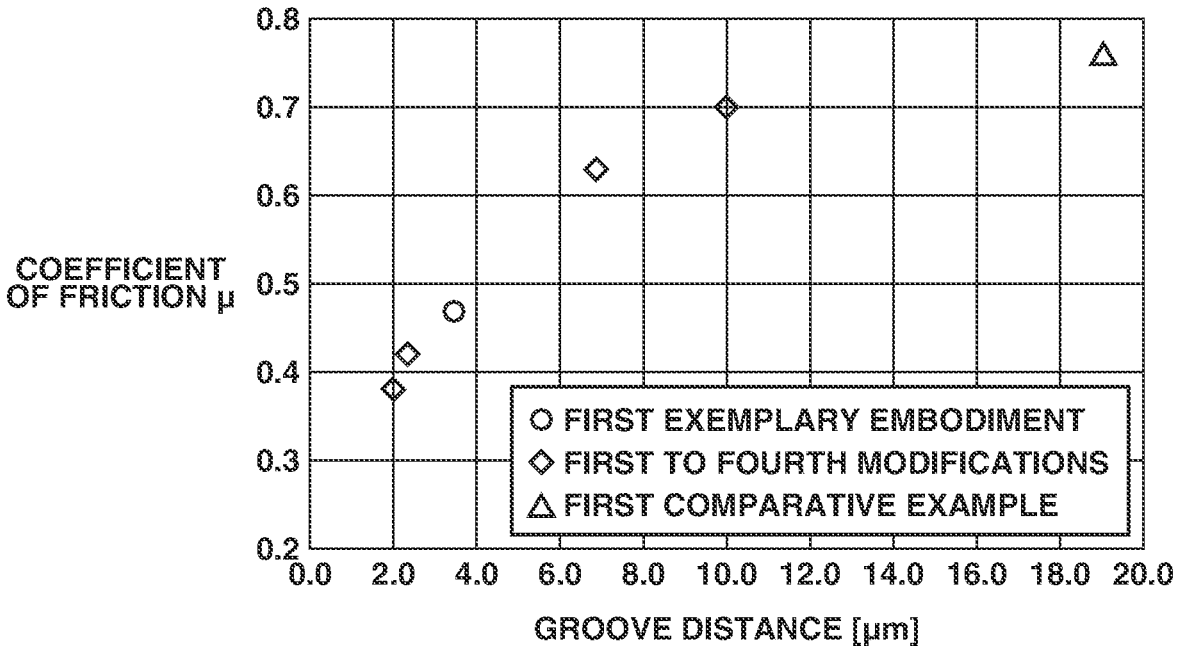
FIG. 4 is a graph illustrating a relationship between the coefficient of friction between a contact member and the intermediate transfer member and a groove distance of the intermediate transfer member according to the first example embodiment.

FIG. 4 is a graph illustrating a relationship between the coefficient of friction between each intermediate transfer belt and the cleaning blade and the groove distance I. A method for measuring the coefficient of friction between each intermediate transfer belt and the cleaning blade will initially be described in detail. The coefficient of friction was measured by using a dedicated measurement tool created for evaluation. The intermediate transfer belt was stretched by two tension rollers, and put into contact with the cleaning blade with one of the tension rollers as a counter roller. The cleaning blade was not configured to swing as illustrated in FIGS. 2A and 2B, but so that the cleaning operation unit 20 was fixed. The set angle θ was set to 24° and the amount of intrusion δ was set to 1.5 mm according to the definitions illustrated in FIG. 2A. The coefficient of friction was measured under a standard environment of 25° C. in temperature and 50% in humidity.

By using the measurement tool described above, 0.80 g/mm$^2$ of toner was applied per unit area of the intermediate transfer belt. The intermediate transfer belt was moved at a speed of 210 mm/sec, and a collection operation was performed to collect the toner on the intermediate transfer belt by the cleaning blade. During the execution of the collection operation, a normal force N acting on the cleaning blade and a frictional force F acting on the counter roller of the cleaning blade were monitored for 30 seconds. From average values, the coefficient of friction μ for each of the intermediate transfer belts according to the first example embodiment, the first to fourth modifications, and the first comparative example was calculated by the following Eq. (1):

$$\mu = F/N. \quad (1)$$

The foregoing measurement was repeated three times for stable measurement, and the coefficient of friction μ was calculated from the third measurements.

The horizontal axis of the graph in FIG. 4 indicates the groove distance I, and the vertical axis the coefficient of friction μ. The measurement results of the intermediate transfer belts according to the first example embodiment, the first to fourth modifications, and the first comparative example are plotted on the graph. As illustrated in the graph of FIG. 4, the coefficient of friction μ tends to decrease as the groove distance I decreases. In other words, the smaller the groove distance I, the lower the frictional resistance between the cleaning blade and the intermediate transfer belt.

Next, each intermediate transfer belt was subjected to durability evaluation in the image forming apparatus 100 including the belt cleaning unit 12 illustrated in FIG. 2B, whereby the cleaning performance and the abrasion status of the cleaning blade were observed. For the durability evaluation, text patterns of respective colors with a printing ratio of 5% were printed in a four-sheet intermittent manner by using A4-size sheets having a grammage of 80 g/m$^2$ (product name: Extra, manufactured by Océ N.V.) under a standard environment of 25° C. in temperature and 50% in humidity. In the process of the durability evaluation, an image for checking the occurrence of a cleaning failure was formed at every predetermined number of sheets (5000 sheets), whereby the cleaning performance was evaluated.

In the foregoing durability evaluation, the occurrence of a cleaning failure was checked at every 5000 sheets by using the following method. Initially, with the output from the secondary transfer power supply E2 off (0 V), a solid red image (100% yellow and 100% magenta) is formed. The output from the secondary transfer power supply E2 is then set to an appropriate value, and three transfer materials P are continuously passed without image formation. Whether the toner of the solid red image remaining hardly transferred to the transfer materials P in the secondary transfer portion N2 is successfully removed by the cleaning blade 21 was observed to check the occurrence of a cleaning failure.

If the toner of the solid red image is successfully removed from the intermediate transfer belt, the three continuously-passed transfer materials P are output in a substantially blank state. If the toner of the solid red image fails to be removed, the toner having slipped through the cleaning blade 21 reaches the secondary transfer portion N2 again, and the toner is transferred to the three continuously-fed transfer materials P and output as cleaning failure images.

FIG. 5 is a table showing the number of sheets fed without the occurrence of a cleaning failure for each of the intermediate transfer belts according to the first example embodiment, the first to fourth modifications, and the first comparative example as the evaluation results of the cleaning performance. As illustrated in FIG. 5, intermediate transfer belts with smaller groove distances I successfully suppressed the occurrence of a cleaning failure and successfully formed images on more transfer materials P. On the other hand, it is observed that a cleaning failure occurred earlier when the groove distance I was reduced to 2.0 μm, like the intermediate transfer belt according to the first modification, than when the groove distance I was 2.3 μm (second modification).

The end of the cleaning blade 21 was observed at the point in time when a cleaning failure occurred. In the configurations other than the fourth modification, partial chippings or abrasion up to above 10 μm was observed occurring at the end of the cleaning blade 21. In other words, a cleaning failure occurs due to the slipping-through of toner originated by a blade chipping or abrasion of greater than 10 μm in the end portion of the cleaning blade 21.

From the foregoing evaluation results, as illustrated in FIGS. 4 and 5, the lower the frictional resistance between the cleaning blade 21 and the intermediate transfer belt, the more suppressed the occurrence of blade chippings and abrasion resulting in a cleaning failure. In other words, by reducing the groove distance I to lower the frictional resistance between the cleaning blade 21 and the intermediate transfer belt, the durability of the cleaning blade 21 can be improved to extend the life of the belt cleaning unit 12 and eventually that of the image forming apparatus 100.

The configuration of the first comparative example caused no cleaning failure up to 100000 sheets. Depending on product specifications, higher durability has been recently demanded of image forming apparatuses. Having a durability of 150000 sheets or more is considered to be capable of being used for an extended period. Even with the configuration of the first comparative example, an image forming apparatus capable of being used for a further extended period can be configured, for example, by handling the belt cleaning unit 12 and the intermediate transfer unit as consumable replacement parts. In such a case, however, the user needs to bear the costs of the replacement parts. Under the circumstances, in terms of a configuration capable of providing sufficient durability over an extended period of use, the groove distance I can be set to 10 μm or less, desirably less than 10 μm.

As illustrated in FIG. 5, the first modification with a groove distance I of 2.0 μm produced a cleaning failure image earlier than the second modification with a groove distance I of 2.3 μm. However, unlike the configurations of the present example embodiment, the first comparative example, and the second to fourth modifications, no chipping or partial abrasion of greater than 10 μm in size was not observed occurring when the end of the cleaning blade 21 was checked upon the occurrence of the cleaning failure image. The cleaning failure at the end stage of durability of the first modification is thus considered to have occurred not from the abrasion of the cleaning blade 21 but from a too low coefficient of friction μ between the cleaning blade 21 and the intermediate transfer belt.

If the coefficient of friction μ between the cleaning blade 21 and the intermediate transfer belt is too low, a cleaning failure occurs when the toner slips through the cleaning blade 21 in the blade nip portion 23. In other words, setting the groove distance I to a value smaller than in the configuration of the first modification can make it difficult to allow for an extended period of use. To suppress the occurrence of a cleaning failure due to a too low frictional resistance between the cleaning blade 21 and the intermediate transfer belt, the groove distance I can be set to 2 μm or more.

As described above, according to the configurations of the present example embodiment and the first to fourth modifications, the durability of the cleaning blade 21 can be improved and the occurrence of a cleaning failure can be suppressed as well by setting the groove distance I to 2 μm or more and 10 μm or less. An image forming apparatus capable of being used for an extended period can thus be provided.

In the present example embodiment, the cross-sectional configuration of the intermediate transfer belt 8 is described to be a two-layer configuration including the surface layer 82. However, this is not restrictive. The intermediate transfer belt 8 may be configured to include a single layer or three or more layers. In any layer configuration, similar effects to those of the present example embodiment can be obtained by applying fine pattern machining to the layer that makes contact with the cleaning blade 21.

Figure 6:
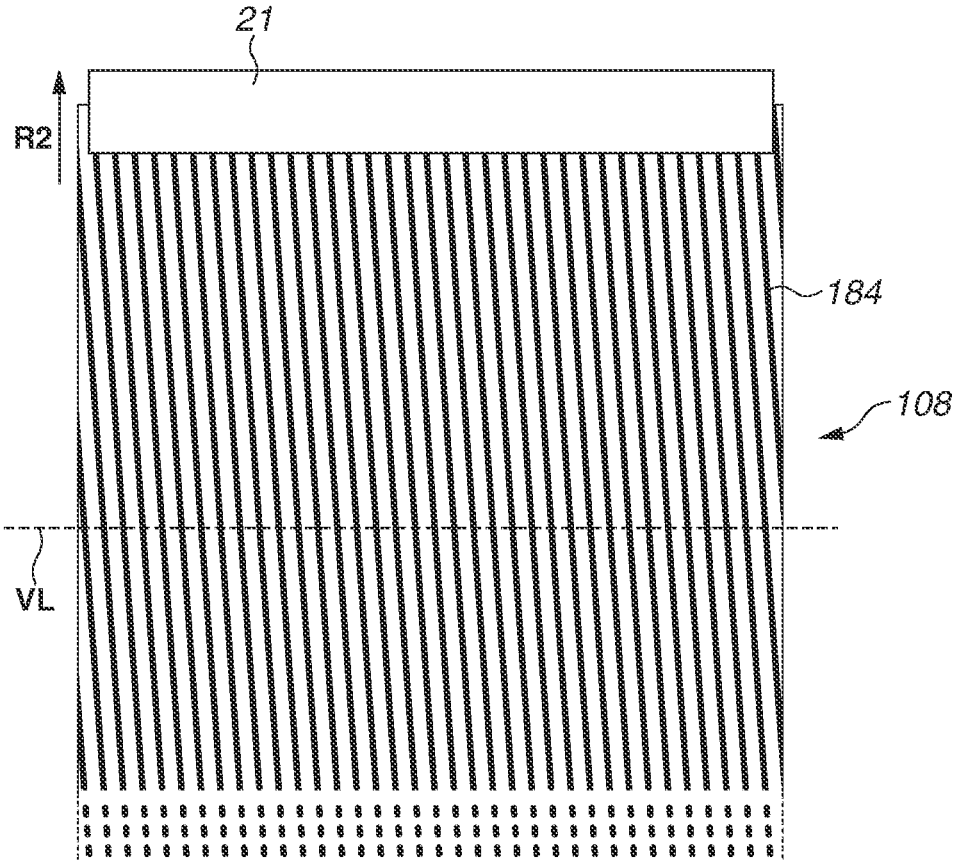
FIG. 6 is a schematic diagram illustrating a configuration of an intermediate transfer belt according to a fifth modification of the first example embodiment.

In the present example embodiment, as illustrated in FIG. 3B, the grooves 84 are formed in parallel with the belt conveyance direction. However, this is not restrictive. FIG. 6 is a schematic diagram illustrating a configuration of an intermediate transfer belt 108 according to a fifth modification. As illustrated in FIG. 6, grooves 184 can be extended along a direction intersecting the width direction orthogonal to the moving direction of the intermediate transfer belt 108, and may be formed at an angle with respect to the moving direction of the intermediate transfer belt 108. A schematic cross-sectional view of the intermediate transfer belt 108 according to the fifth modification, taken at the position of a line VL drawn in the width direction of the intermediate transfer belt 108, is similar to that in FIG. 3A. To provide the effect of reducing the coefficient of friction against the cleaning blade 21, the angle that the extending direction of the grooves 184 forms with respect to the moving direction of the intermediate transfer belt 108 can be set to 45° or less, desirably 10° or less.

In the present example embodiment, the grooves 84 are described to be continuously formed around the intermediate transfer belt 8. However, this is not restrictive. Instead of being continuously formed around the intermediate transfer belt 8, the grooves 84 may be discontinuous in the moving direction of the intermediate transfer belt 8. In other words, the grooves 84 may be discontinuously formed around the intermediate transfer belt 8.

A solid lubricant may be added to the surface layer 82. A solid lubricant may be selected and used as appropriate from among fluorine-containing particles such as polytetrafluoroethylene (PTFE) resin powders, vinyl fluoride resin powders, and graphite fluoride, and copolymers thereof. The addition of the solid lubricant to the surface layer 82 can reduce the frictional resistance between the cleaning blade 21 and the intermediate transfer belt 8. An auxiliary unit may be included to add the solid lubricant in order to adjust the frictional resistance between the cleaning blade 21 and the intermediate transfer belt 8.

To stabilize the frictional resistance between the cleaning blade 21 and the intermediate transfer belt 8, the grooves 84 can be arranged at equal distances in the width direction of the intermediate transfer belt 8. It will be understood that the essential effects sill can be produced if the grooves 84 are formed at slightly-different, substantially equal distances. Such slightly-different, substantially equal distances shall also be covered by equal distances as employed in the present example embodiment.

A second example embodiment will be described below. In the first example embodiment, the average groove distance of the intermediate transfer belt is determined in view of the durability of the cleaning blade against abrasion and chippings mainly in a swingable cleaning configuration. In the present example embodiment, an average groove distance capable of both improving the durability of the cleaning blade and ensuring stable cleaning performance will be described in consideration of setting tolerances of the cleaning blade and cleaning robustness. The following description will be given by using a fixing system in which the cleaning operation unit 20 is fixed and the setting tolerances of the cleaning blade and the conditions about the cleaning robustness are severer than in the swingable system as an example.

[Setting of Cleaning Blade and Evaluation of Cleaning Performance]

FIG. 7 illustrates evaluation results of cleaning performance of intermediate transfer belts having respective different groove distances I, with the cleaning blade at various set angles θ and amounts of intrusion δ. The cleaning performance was evaluated by checking for occurrence of slipping-through of toner, i.e., whether toner slipped through the cleaning blade by using the fixing system of fixing the cleaning operation unit 20, already described in the first example embodiment. Evaluations were made for a total of 16 blade settings by combining four levels of the set angle θ of the cleaning blade, 20°, 24°, 28°, and 32°, and four levels of the amount of intrusion δ, 0.6 mm, 1.0 mm, 1.4 mm, and 1.8 mm.

In FIG. 7, the result "OK" indicates that cleaning performance was ensured. The result "NG" indicates that slipping-through of toner, i.e., a cleaning failure occurred. A new cleaning blade was used for the test. A cleaning failure that occurred in this test is not one resulting from chippings or partial abrasion at the end of the cleaning blade as described in the durability evaluation in the image forming apparatus 100 according to the first example embodiment, but a phenomenon originating from an inappropriate setting of the cleaning blade. The total area of "OKs" where cleaning performance is ensured for respective settings of the cleaning blade is referred to as a cleaning margin. As the cleaning margin is wider, the degree of freedom of the cleaning blade setting (θ, δ) is more improved and the cleaning performance is likely to be more stable.

Referring to FIG. 7, the cleaning margin increases as the groove distance I decreases from 19 μm. The cleaning margin tends to decrease if the groove distance I decreases further from the configuration of the intermediate transfer belt with a groove distance I of 3.5 μm. In other words, the relationship between the groove distance I and the cleaning margin has an inflection point. The widest cleaning margin is obtained around 3.5 μm that is the groove distance I of the intermediate transfer belt 8 according to the first example embodiment.

In the fixing system, the setting (θ, δ) of the cleaning blade needs to allow for tolerances of at least Δ4° in the set angle θ and at least Δ0.4 mm in the amount of intrusion δ because of the accuracy of parts constituting the belt cleaning unit 12 and the accuracy of assembly. Such tolerances correspond to 2×2 cells in FIG. 7. Intermediate transfer belts capable of ensuring a cleaning margin that covers such 2×2 cells are the intermediate transfer belts having a groove distance I of 2.0 μm, 2.3 μm, 3.5 μm, and 6.8 μm.

Note that the intermediate transfer belt having a groove distance I of 2.0 μm does provide 2×2 cells of cleaning margin, whereas a further reduction in the groove distance I makes it difficult to ensure the cleaning margin covering 2×2 cells and the robustness can be insufficient. To allow for setting tolerances of the cleaning blade and ensure cleaning robustness as well, the groove distance I can be set to 2 μm or more and 7 μm or less in view of cleaning performance.

An example of the fixed cleaning configuration has been descried above. However, this is not restrictive. A wide cleaning margin can also be provided in a swingable configuration by setting the groove distance I of the grooves formed in the intermediate transfer belt within the range described in the present example embodiment. More specifically, according to the configuration of the present example embodiment, the average groove distance of the intermediate transfer belt is set to 2 μm or more and 7 μm or less. This can ensure cleaning performance in consideration of the setting tolerances of the cleaning blade in addition to the effects of the first example embodiment, whereby good cleaning performance can be obtained.

The groove distance I is not limited to the foregoing as long as the cleaning margin covers the setting tolerances of the cleaning blade. In the present example embodiment, setting tolerances (Δ4° and Δ0.4 mm) for a typical cleaning blade of fixed configuration have been described as an example. The defined values of the average groove distance can be extended if the blade setting tolerances can be reduced by improving the parts accuracy or narrowing assembly tolerances.

While the present disclosure has been described with reference to example embodiments, it is to be understood that the disclosure is not limited to the disclosed example embodiments. The scope of the following claims is to be accorded the broadest interpretation so as to encompass all such modifications and equivalent structures and functions.

What is claimed is:

1. A method for manufacturing an endless intermediate transfer belt used in an image forming apparatus, comprising:

a first step of preparing a base layer and a surface layer, the base layer being a thickest layer in a thickness direction of the intermediate transfer belt, the surface layer being on a first surface of the base layer, the surface layer located on an outer peripheral surface side of the intermediate transfer belt at a time of use; and a second step of forming a plurality of grooves in a second surface of the surface layer by an imprinting process, the second surface being located on an opposite side that is opposite of a side where the base layer exists, the plurality of grooves extending along a moving direction of the intermediate transfer belt;

wherein, in the second step, the grooves are formed in the second surface such that an average distance between adjacent grooves of the plurality of grooves in a width direction orthogonal to the moving direction of the intermediate transfer belt is 2 μm or more and 7 μm or less, and wherein, in the second step, a plurality of protrusions protruding from a flat portion of the second surface are formed on the second surface, and each groove of the plurality of grooves transitions into a protrusion of the plurality of protrusions.

2. The method according to the claim 1, wherein, in the first step, the surface layer is made of an acrylic copolymer.

3. The method according to claim 1, wherein, in the first step, an ion conductive agent is added to the base layer.

4. The method according to claim 1, wherein, in the first step, the surface layer has a thickness of 1 μm or more and 5 μm or less.

5. The method according to claim 4, wherein, in the first step, the thickness of the surface layer is 3 μm or less.

6. The method according to claim 1, wherein, in the first step, a solid lubricant is added to the surface layer.

7. The method according to claim 6, wherein, in the first step, the solid lubricant is a fluorine-containing particle.

8. The method according to claim 7, wherein, in the first step, the fluorine-containing particle is polytetrafluoroethylene (PTFE).

9. The method according to claim 1, wherein, in the first step, a solid lubricant is added to the outer peripheral surface of the intermediate transfer member which makes contact with the image bearing member and a blade.

10. The method according to claim 1, wherein, in the second step, the plurality of grooves have an opening width of 0.5 μm or more and 3 μm or less in the width direction of the intermediate transfer member.

11. The method according to claim 10, wherein, in the second step, the opening width of each of the plurality of grooves is a distance between peaks of the protrusions that are adjacent to each respective groove of the plurality of grooves.

12. The method according to claim 1, wherein, in the second step, the plurality of grooves is formed at equal distances.

13. The method according to claim 1, wherein, in the second step, the plurality of grooves are formed along the moving direction at a predetermined angle with respect to the width direction.

14. The intermediate transfer belt manufactured using the method according to claim 1.

15. An image forming apparatus comprising:

an image bearing member configured to bear a toner image;

a movable intermediate transfer member configured to contact with the image bearing member, the toner image borne on the image bearing member being primarily transferred to the intermediate transfer member; and a collection unit arranged downstream of a secondary transfer portion with respect to a moving direction of the intermediate transfer member, the secondary transfer portion being configured to secondarily transfer the toner image primarily transferred to the intermediate transfer member from the intermediate transfer member to a transfer material, the collection unit including a contact member configured to contact with the intermediate transfer member, the collection unit being configured to collect toner remaining on the intermediate transfer member having passed through the secondary transfer portion by using the contact member, wherein the intermediate transfer member includes a layer made of an acrylic copolymer on an outer peripheral surface that makes contact with the image bearing member and the contact member, a plurality of grooves being formed in the layer along the moving direction across a width direction of the intermediate transfer member, the width direction intersecting the moving direction, wherein the plurality of grooves is recessed relative to a flat surface of the layer, and the layer includes a plurality of protrusions protruding relative to the flat surface of the layer at positions adjacent to the respective grooves, wherein each groove of the plurality of grooves transitions into a protrusion of the plurality of protrusions, and wherein an average distance between adjacent grooves of the plurality of grooves in the width direction is 2 μm or more and 10 μm or less.

16. The image forming apparatus according to claim 15, wherein a distance between the adjacent grooves of the plurality of grooves in the width direction is a distance between peaks of the protrusions.

17. The image forming apparatus according to claim 15, wherein the average distance between the adjacent grooves of the plurality of grooves in the width direction is 2 μm or more and 7 μm or less.

18. The image forming apparatus according to claim 15, wherein the intermediate transfer member includes a base layer that is a thickest layer among a plurality of layers constituting the intermediate transfer member in a thickness direction of the intermediate transfer member, and wherein the layer having the plurality of grooves formed therein is a surface layer formed on a surface of the base layer.

19. The image forming apparatus according to claim 18, wherein the surface layer has a thickness of 1 μm or more and 5 μm or less.

20. The image forming apparatus according to claim 18, wherein a solid lubricant is added to the surface layer.

21. The image forming apparatus according to claim 15, wherein a solid lubricant is added to the outer peripheral surface of the intermediate transfer member which makes contact with the image bearing member and the contact member.

22. The image forming apparatus according to claim 21, wherein the solid lubricant is a fluorine-containing particle.

23. The image forming apparatus according to claim 22, wherein the fluorine-containing particle is polytetrafluoroethylene (PTFE).

24. The image forming apparatus according to claim 15, wherein the grooves have an opening width of 0.5 μm or more and 3 μm or less in the width direction of the intermediate transfer member, the width direction being orthogonal to the moving direction.

25. The image forming apparatus according to claim 15, wherein the plurality of grooves is formed at equal distances.

26. The image forming apparatus according to claim 15, wherein the grooves are formed along the moving direction at a predetermined angle with respect to the width direction.

27. The image forming apparatus according to claim 26, wherein the contact member is a blade made of polyurethane and makes contact with the intermediate transfer member in a counter direction.

28. The image forming apparatus according to claim 27, wherein the contact member has a rubber hardness of 70° or more and 80° or less with respect to Japanese Industrial Standard K 6253.

29. The image forming apparatus according to claim 27, wherein a contact pressure of the contact member with the intermediate transfer member is 0.4 N/cm or more and 0.8 N/cm or less.

* * * * *